US008291527B2

(12) United States Patent
Pan et al.

(10) Patent No.: US 8,291,527 B2
(45) Date of Patent: Oct. 23, 2012

(54) DRIVE APPARATUS FOR BIDET TOILET

(75) Inventors: Ji Cheng Pan, Shenzhen (CN); Fei Li, Shenzhen (CN); Yong Qiang Song, Shenzhen (CN); Gang Peng, Shenzhen (CN); Zhi Qiang Wu, Shenzhen (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 453 days.

(21) Appl. No.: 12/508,067

(22) Filed: Jul. 23, 2009

(65) Prior Publication Data

US 2010/0017950 A1 Jan. 28, 2010

(30) Foreign Application Priority Data

Jul. 23, 2008 (CN) ..... 2008 1 0142503

(51) Int. Cl.
*A47K 3/022* (2006.01)

(52) U.S. Cl. ..... 4/443

(58) Field of Classification Search ..... 4/443, 420.4
See application file for complete search history.

(56) References Cited

U.S. PATENT DOCUMENTS 4,570,294 A * 2/1986 Meyn ..... 452/112
4,628,548 A * 12/1986 Kurosawa et al. ..... 4/420.4
4,704,748 A * 11/1987 Takeda et al. ..... 4/420.4
5,025,511 A * 6/1991 Takeda et al. ..... 4/447
5,050,249 A * 9/1991 Takeda et al. ..... 4/443
2005/0257316 A1* 11/2005 Huang ..... 4/420.4
2008/0047055 A1* 2/2008 Lim ..... 4/447

FOREIGN PATENT DOCUMENTS

CN 2777085 Y 5/2006
CN 101046107 A 10/2007
CN 201033895 Y 3/2008

* cited by examiner

*Primary Examiner* — Lori Baker
(74) *Attorney, Agent, or Firm* — Muncy, Geissler, Olds & Lowe, PLLC

(57) ABSTRACT

Apparatus for driving a nozzle of a bidet toilet, has a base 1; a nozzle 2; a guide device 11, 12 formed on the base for guiding linear movement of the nozzle; a motion output device 7 having an output shaft 71; a driving wheel 3 attached to the output shaft and being rotatably driven with the output shaft; a pair of guide wheels 4,5 rotatably fixed relative to the base, and a non-toothed conveyer 6 wound around the driving wheel 3 and the guide wheels 4, 5 and fastened to the nozzle 2. Rotation of the driving wheel 3 causes linear movement of the nozzle 2.

13 Claims, 3 Drawing Sheets

DRIVE APPARATUS FOR BIDET TOILET

CROSS REFERENCE TO RELATED APPLICATIONS

This non-provisional patent application claims priority under 35 U.S.C. §119(a) from Patent Application No. 200810142503.7 filed in The People's Republic of China on Jul. 23, 2008.

FIELD OF THE INVENTION

This invention relates to toilets and in particular, to a drive apparatus for a bidet toilet.

BACKGROUND OF THE INVENTION

Bidet toilets have become widely used. A bidet toilet has a retractable wand or nozzle through which washing water is sprayed out for washing the "bottom" and the like of a user sitting on a seat of the toilet. A drive apparatus is used to move the nozzle along a linear path between an active position where it is extended or use and a retracted position. The apparatus includes a motor which has a rotating output shaft which is connected to the nozzle through a number of gears and a rack to drive the nozzle by a rack and pinion type arrangement. The arrangement is complicated and the cost is high. Furthermore, the gears are prone to be worn out and noise generated by the gears is great.

As such, it is desirable to provide an improved drive apparatus for nozzles of bidet toilets which can overcome the above-mentioned problems.

SUMMARY OF THE INVENTION

Accordingly, in one aspect thereof, the present invention provides a drive apparatus for driving a nozzle of a bidet toilet, the drive apparatus comprising: a base; a nozzle; a guide device formed on the base for guiding linear movement of the nozzle; a motion output device having an output shaft; a driving wheel attached to the output shaft and being rotatably driven with the output shaft; a pair of guide wheels rotatably fixed relative to the base, and a non-toothed conveyer wound around the driving wheel and the guide wheels and fastened to the nozzle, whereby rotation of the driving wheel causes linear movement of the nozzle.

Preferably, the conveyer is a soft belt or string.

Preferably, a tensioner is attached to the base and presses against the conveyer to keep the conveyer under tension.

Preferably, the tensioner comprises a bracket attached to a seat of the base, a tension wheel rotatably mounted to the bracket, and a spring compressed between the bracket and the seat to urge the tension wheel to press against the conveyer to maintain tension in the conveyer.

Preferably, the base also has a collar formed at an end thereof and arranged to slidably receive a part of the nozzle.

Preferably, a frame is attached to an end of the base remote from the collar, wherein the frame comprises a pin inserted into an opening formed in the base from one side of the base, a stop bar configured to block the nozzle from sliding away from the base, a latch engaging the opposite side of the base, and an axle around which one of the guide wheels is rotatably attached.

Preferably, the guide device comprises a guide rail formed at one of the nozzle and the base and a guide slot formed at the other of the nozzle and the base.

Preferably, each of the driving wheel and the guide wheels has a groove formed in the circumferential surface thereof to receive the conveyer.

Preferably, the conveyer has two which are fastened to the driving wheel after being wound around the driving wheel a plurality of turns.

Preferably, the conveyer is fixed to the nozzle.

Preferably, the conveyer is wound around a clip of the nozzle.

BRIEF DESCRIPTION OF THE DRAWINGS

A preferred embodiment of the invention will now be described, by way of example only, with reference to figures of the accompanying drawings. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
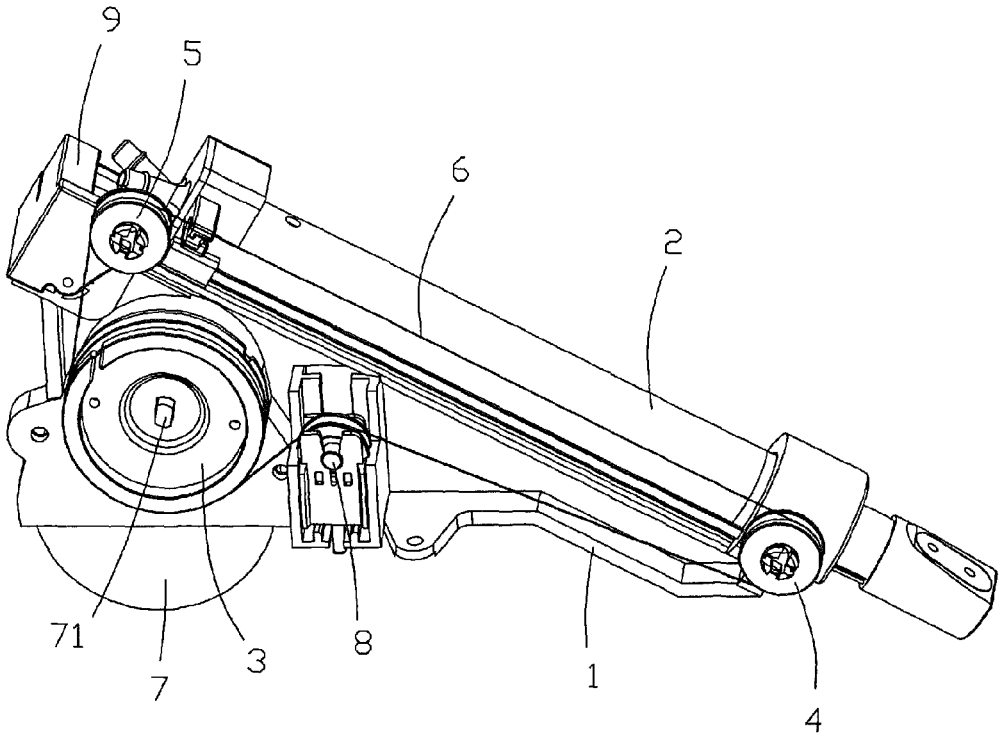
FIG. 1 is an isometric view of a drive apparatus for a nozzle of a bidet toilet in accordance with a preferred embodiment of the present invention.

FIG. 1 illustrates a drive apparatus for driving a nozzle of a bidet toilet in accordance with a preferred embodiment of the present invention. The drive apparatus comprises a base 1 configured to be fastened within a toilet pedestal (not shown) of the toilet, a nozzle 2 having a nozzle head with at least one water discharge port, a driving wheel 3, a pair of guide wheels 4 and 5, a conveyer in the form of a string 6, a motion output device 7, a tensioner 8, and a frame 9. The driving wheel 3, guide wheels 4 and 5, string 6, tensioner 8 and frame 9 convert the rotating motion of the output shaft 71 of the motion output device 7 into linear motion of the nozzle 2. The motion output device 7 comprises a stepping motor and a gearbox with an output shaft 71.

Figure 2:
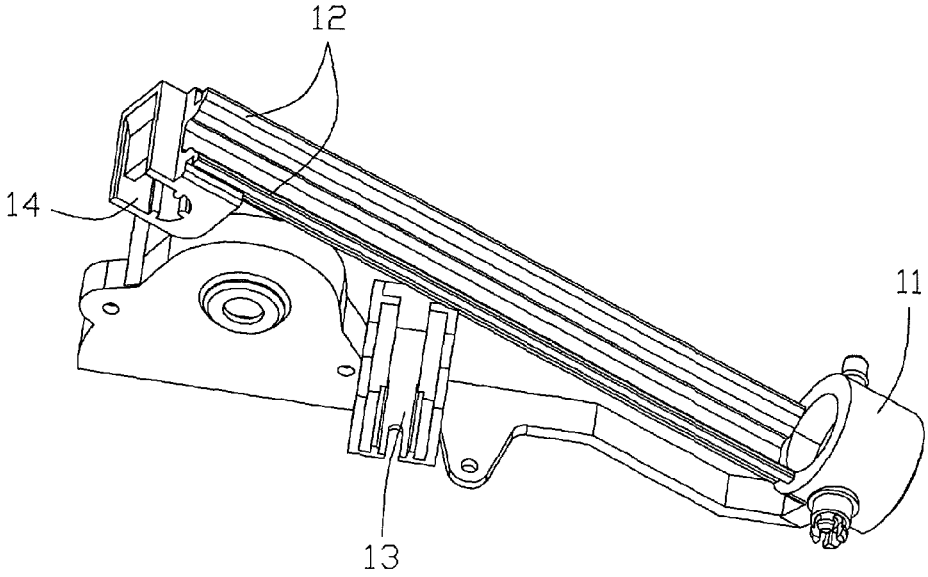
FIG. 2 is an isometric view of a base of the drive apparatus of FIG. 1.
Figure 3:
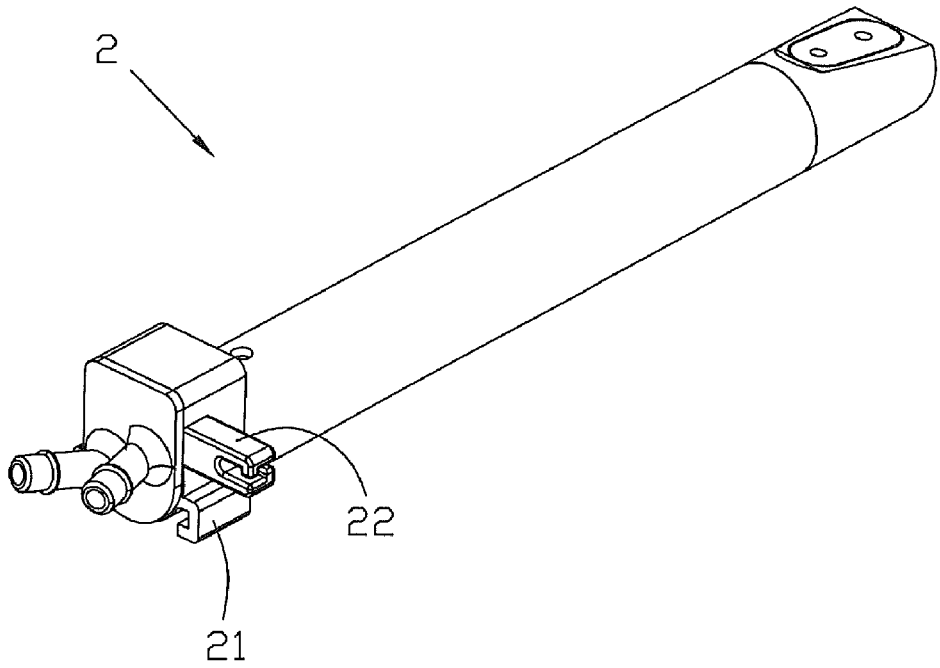
FIG. 3 is an isometric view of the nozzle of the bidet toilet.

Referring to FIGS. 2 and 3, the base 1 comprises a collar 11 for slidably supporting and guiding the nozzle 2, and a pair of guide rails 12 for slidably engaging with a pair of guide slots 21 formed on the nozzle 2 to guide linear movement of the nozzle 2 through the collar 11. The guide wheel 4 is rotatably attached to one end of the base 1, preferably directly to the collar 11 by a stub axle. The base 1 further comprises a seat 13 configured for mounting the tensioner 8 and a mounting opening 14 configured for mounting the frame 9.

Figure 4:
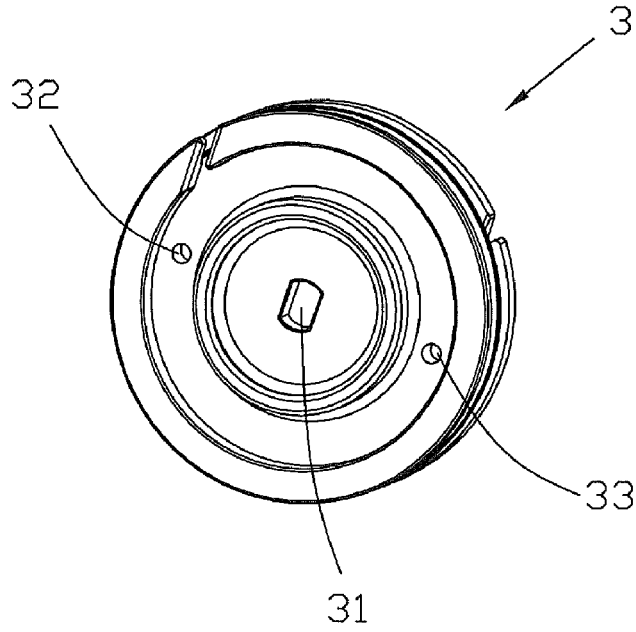
FIG. 4 is an isometric view of a driving wheel of the drive apparatus of FIG. 1.

Referring to FIGS. 1 and 4, the driving wheel 3 has an opening 31 for mounting the driving wheel onto the output shaft 71 such that the driving wheel 3 is fixed to the shaft to be rotatably driven by the output shaft 71, and a pair of threaded holes 32 and 33 for receiving screws (not shown) therein. The string 6 is wound around the driving wheel 3 and both ends of the string 6 are fastened to the screws respectively. Alternatively, a pair of posts may be formed on the driving wheel 3 and the ends of the string 6 fixed to the posts.

Figure 5:
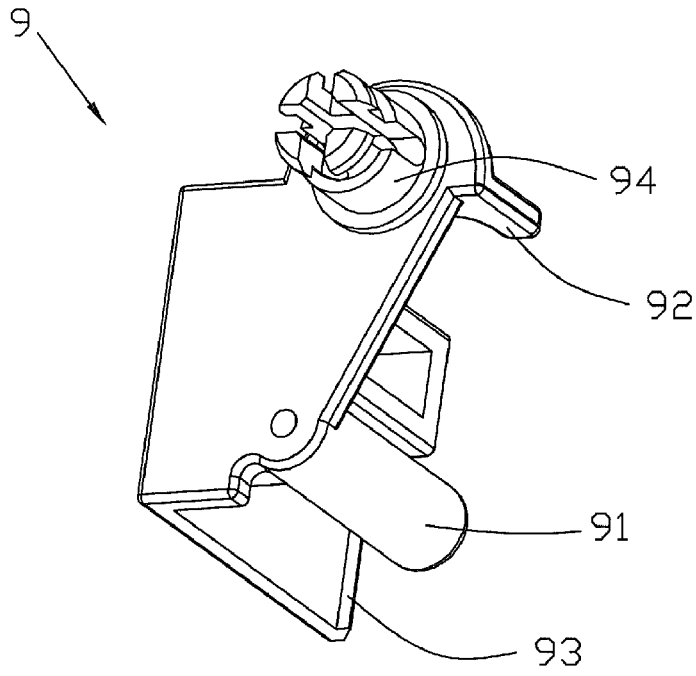
FIG. 5 is an isometric view of a frame of the drive apparatus of FIG. 1.

As shown in FIG. 5, the frame 9 comprises a pin 91, a stop bar 92, a latch 93 and an axle 94. The frame 9 is attached to the base 1, adjacent to the end the rails 12 remote from the collar 11, by the pin 91 being inserted into the opening 14 of the base 1 from one side of the base 1 and the latch 93 catching on the opposite side of the base 1. The stop bar 92 is arranged to blocking the nozzle 2 from sliding off the end of the rails 12. The guide wheel 5 is rotatably attached to the axle 94.

The driving wheel 3 and the guide wheels 4 and 5 each have a groove formed in the circumferential surface thereof to guide the string 6 around the wheels. The nozzle 2 is fastened to the string 6 between the two guide wheels 4 and 5 via a clip 22 formed on one side of the nozzle 2. The string 6 may be wound on the clip 22, clamped by the clip 22 and/or adhered to the clip 22. The ends of the string 6 are wound onto the driving wheel 3 before being fix to the screws. When the driving wheel 3 rotates, one end of the string 6 is wound onto the driving wheel 3 while the other end is unwound from the driving wheel. Thus as the string is moved around the closed circuit formed by the three wheels, the nozzle is moved linearly along the rails 12 and through the collar 11. The direction of rotation of the driving wheel 3 determines the direction of movement of the nozzle. In the arrangement shown in FIG. 1, clockwise rotation of the driving wheel 3 causes the nozzle to move to the active or extended position, while counter clockwise rotation of the driving wheel 3 causes the nozzle to retract.

Figure 6:
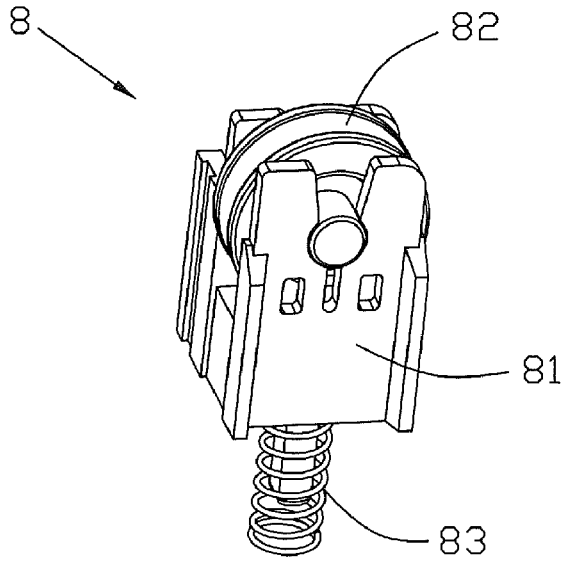
FIG. 6 is an isometric view of a tensioning device of the drive apparatus of FIG. 1.

Referring now to FIG. 6, the tensioner 8 is configured to keep tension in the string 6 to prevent the string 6 from becoming loose in the groove in wheels 4 and 5 and sliding off the wheels 4 and 5. The tensioner 8 comprises a bracket 81, a tension wheel 82 pivotably mounted to the top portion of the tensioner 8, and a spring 83. The bracket 81 is mounted in the seat 13 of the base 1. The spring 83 is compressed between the bracket 81 and the seat 13 to generate a biasing force to urge the tension wheel 82 to press the string 6 upward, thereby keeping tension on the string 6 at all times.

In the above mentioned embodiments of the present invention, there is no slippage movement between the wheels and the string. Thus, wear of the string is greatly reduced. Also, the noise generated by the drive apparatus is reduced and reliability of the drive apparatus is improved.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, the string may be replaced by any other suitable conveyer, for example, non-teeth soft belt.

The invention claimed is:

1. A drive apparatus for driving a nozzle of a bidet toilet, the drive apparatus comprising: a base; a nozzle; a guide device formed on the base for guiding linear movement of the nozzle; a motion output device having an output shaft; a driving wheel attached to the output shaft and being rotatably driven with the output shaft; a pair of guide wheels rotatably fixed relative to the base; a non-toothed conveyer wound around the driving wheel and the guide wheels and fastened to the nozzle whereby rotation of the driving wheel causes linear movement of the nozzle; and a tensioner which is attached to the base and presses against the conveyer to keep the conveyer under tension, wherein the tensioner comprises a bracket attached to a seat of the base, a tension wheel rotatably mounted to the bracket, and a spring compressed between the bracket and the seat to urge the tension wheel to press against the conveyer to maintain tension in the conveyer.

2. The drive apparatus of claim 1, wherein the conveyer is a soft belt or string.

3. The drive apparatus of claim 1, wherein the base further comprises a collar formed at an end thereof and arranged to slidably receive a part of the nozzle.

4. The drive apparatus of claim 3, further comprising a frame attached to an end of the base remote from the collar, wherein the frame comprises a pin inserted into an opening formed in the base from one side of the base, a stop bar configured to block the nozzle from sliding away from the base, a latch engaging the opposite side of the base, and an axle around which one of the guide wheels is rotatably attached.

5. The drive apparatus of claim 1, wherein the guide device comprises a guide rail formed at one of the nozzle and the base and a guide slot formed at the other of the nozzle and the base.

6. The drive apparatus of claim 1, wherein each of the driving wheel and the guide wheels has a groove formed in the circumferential surface thereof to receive the conveyer.

7. The drive apparatus of claim 1, wherein the conveyer is fixed to the nozzle.

8. A drive apparatus for driving a nozzle of a bidet toilet, the drive apparatus comprising: a base; a nozzle; a guide device formed on the base for guiding linear movement of the nozzle; a motion output device having an output shaft; a driving wheel attached to the output shaft and being rotatably driven with the output shaft; a pair of guide wheels rotatably fixed relative to the base; a collar formed at one end of the base and arranged to slidably receive a part of the nozzle; a non-toothed conveyer wound around the driving wheel and the guide wheels and fastened to the nozzle, whereby rotation of the driving wheel causes linear movement of the nozzle; and a frame attached to an end of the base remote from the collar, wherein the frame comprises a pin inserted into an opening formed in the base from one side of the base, a stop bar configured to block the nozzle from sliding away from the base, a latch engaging the opposite side of the base, and an axle around which one of the guide wheels is rotatably attached.

9. The drive apparatus of claim 8, wherein the conveyer is a soft belt or string.

10. The drive apparatus of claim 8, further comprising a tensioner which is attached to the base and presses against the conveyer to keep the conveyer under tension.

11. The drive apparatus of claim 8, wherein the guide device comprises a guide rail formed at one of the nozzle and the base and a guide slot formed at the other of the nozzle and the base.

12. The drive apparatus of claim 8, wherein each of the driving wheel and the guide wheels has a groove formed in the circumferential surface thereof to receive the conveyer.

13. The drive apparatus of claim 8, wherein the conveyer is fixed to the nozzle.

* * * * *